US007494188B1

(12) United States Patent
Lin

(10) Patent No.: US 7,494,188 B1
(45) Date of Patent: Feb. 24, 2009

(54) HEADREST FOR AN OFFICE CHAIR

(76) Inventor: Yu-Zen Lin, No. 19-1, Jeu Kuang 1 St., Ta-Liao Hsiang Kaohsiung Hsien (TW)

( * ) Notice: Subject to any disclaimer, the term of this patent is extended or adjusted under 35 U.S.C. 154(b) by 0 days.

(21) Appl. No.: 11/843,722

(22) Filed: Aug. 23, 2007

(51) Int. Cl.
*A47C 7/36* (2006.01)

(52) U.S. Cl. ..... 297/397; 297/408; 297/410

(58) Field of Classification Search ..... 297/405, 297/397, 399, 391, 410, 408
See application file for complete search history.

(56) References Cited

U.S. PATENT DOCUMENTS 490,541 A * 1/1893 Case ..... 297/405
3,292,974 A * 12/1966 Gelbman ..... 297/400
6,857,704 B2 * 2/2005 Stenzel et al. ..... 297/408
7,303,232 B1 * 12/2007 Chen ..... 297/284.8
2003/0141751 A1 * 7/2003 Stenzel et al. ..... 297/410
2005/0088027 A1 * 4/2005 Yetukuri et al. ..... 297/408

* cited by examiner

*Primary Examiner*—Milton Nelson, Jr.
(74) *Attorney, Agent, or Firm*—Ming Chow; Sinorica, LLC

(57) ABSTRACT

A headrest for an office chair includes a headrest body, two connecting blocks, a support frame and a hook. The support frame has two L-shaped hooks in an intermediate portion, and the headrest can be assembled with a backrest of an office chair by a hook and L-shaped hooks of the support frame to enable the headrest being assembled with any office chair easily. Moreover, the headrest body can be adjusted in its height and angle to be usable by users of different physical heights.

4 Claims, 5 Drawing Sheets

HEADREST FOR AN OFFICE CHAIR

BACKGROUND OF THE INVENTION

1. Field of the Invention

This invention relates to a headrest for an office chair, particularly to one easily adjustable in its angle and height, and conveniently assembled and disassembled.

2. Description of the Prior Art

A conventional headrest of an office chair is generally made stationary, impossible to be assembled with any office chairs or to be adjusted in its angle and height, so users of different physical height cannot sit comfortably, obliged to change its sitting posture to conform to the height of the headrest. Therefore, users may suffer from a sour head and back owing to a long period of use.

SUMMARY OF THE INVENTION

This invention is to offer a headrest for an office chair, easily adjustable in its angle and height, and simple to be assembled on and disassembled from an office chair.

The features of the invention are a headrest body, plural connecting blocks, a support frame and a hook. The headrest body is wrapped around by a soft material, provided with two shafts connected to the support frame. The connecting blocks are hollow columns connected to the shaft of the headrest body, provided with a projecting block with a through hole for a fastener to fit through to connect to the support frame. The support frame is Y-shaped, having a ball with a slot respectively at two upper ends, with the projecting block of the connecting block to fit therein, and hooks extending from an intermediate portion to hook on a backrest of an office chair to hang the headrest body on the office chair. The hook is L-shaped, fixed in a recess of the support frame by fasteners.

Then the shafts enable the headrest to be adjusted in its height, and the support frame can let the headrest adjusted in its angle.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
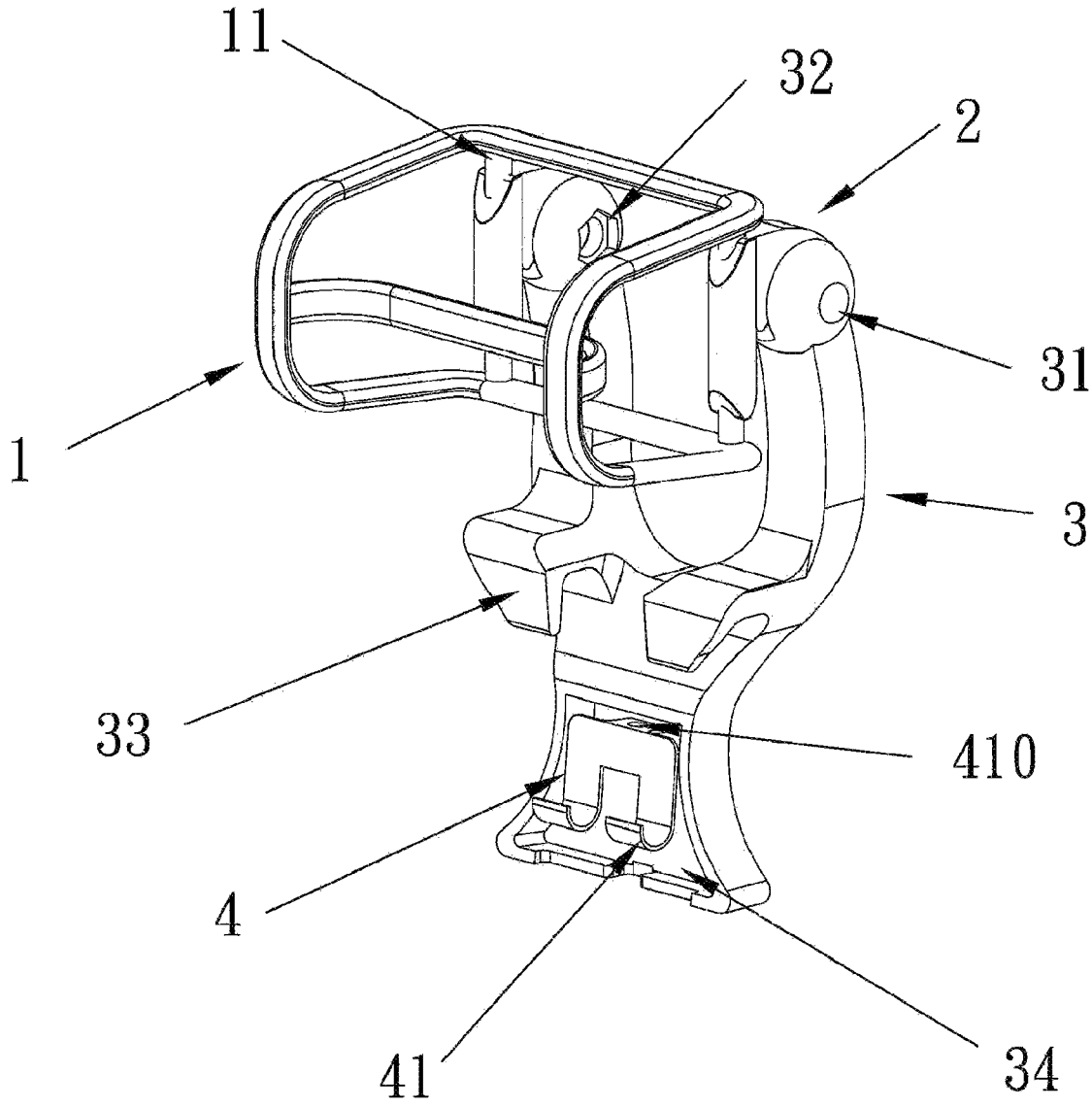
FIG. 1 is a perspective view of a headrest for an office chair in the present invention.
Figure 2:
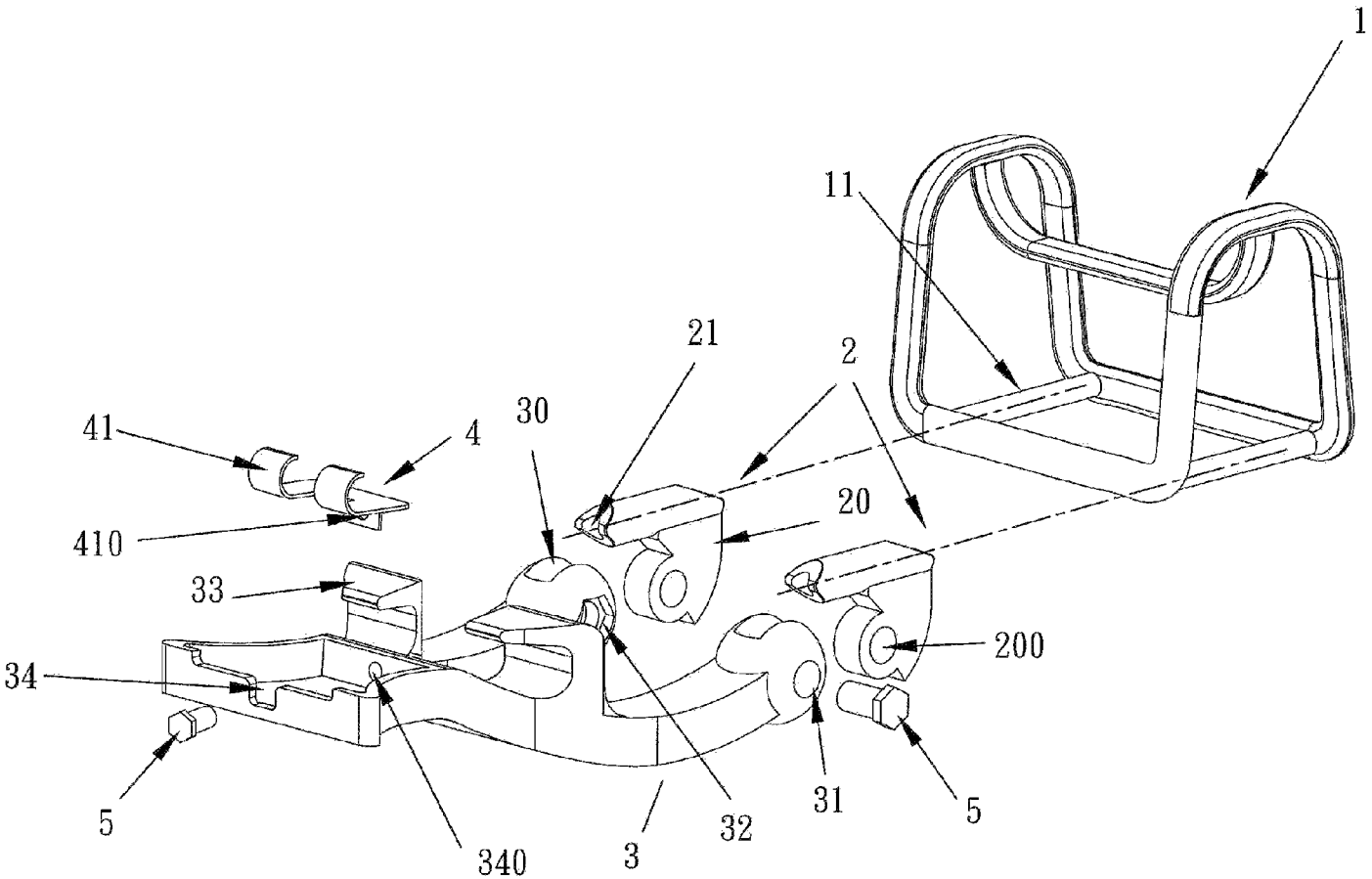
FIG. 2 is an exploded perspective view of the headrest for an office chair in the present invention.

A preferred embodiment of a headrest for an office chair in the present invention, as shown in FIGS. 1 and 2, includes a headrest body 1, two connecting blocks 2, a support frame 3 and plural hooks 4 as main components.

The headrest body 1 is wrapped around by a layer of soft material and provided with two shafts 11.

The connecting block 2 is a hollow column connected with the headrest body 1 by means of the shafts 11, having a projecting block 20 extending rearward from the hollow column, and the projecting block 20 has a through hole 200 for a fastener 5 to screw the projecting block 20 with the support frame 3.

The support frame 3 is nearly shaped as Y, having a ball formed at an outer end of two side rod portions and a slot 30 formed in the ball for the projecting block 20 to fit in and secured stably by the fastener 5 engaging with a threaded hole 31 formed in the ball and a nut fitted in a nut recess 32 of the threaded hole 31. Further, the support frame 3 is provided with an L-shaped hook 33 respectively extending from an intermediate portion of the two side rod portions for hooking with a backrest of an office chair, and a recess 34 formed in a lower portion with a threaded hole 340 in an upper wall of the recess 34.

The hook 4 is shaped nearly as L, having two curved portions 41 and a threaded hole 410 in a rear portion for the fastener 5 to engage with to fix the hook 4 on the recess of the support frame 3.

Figure 3:
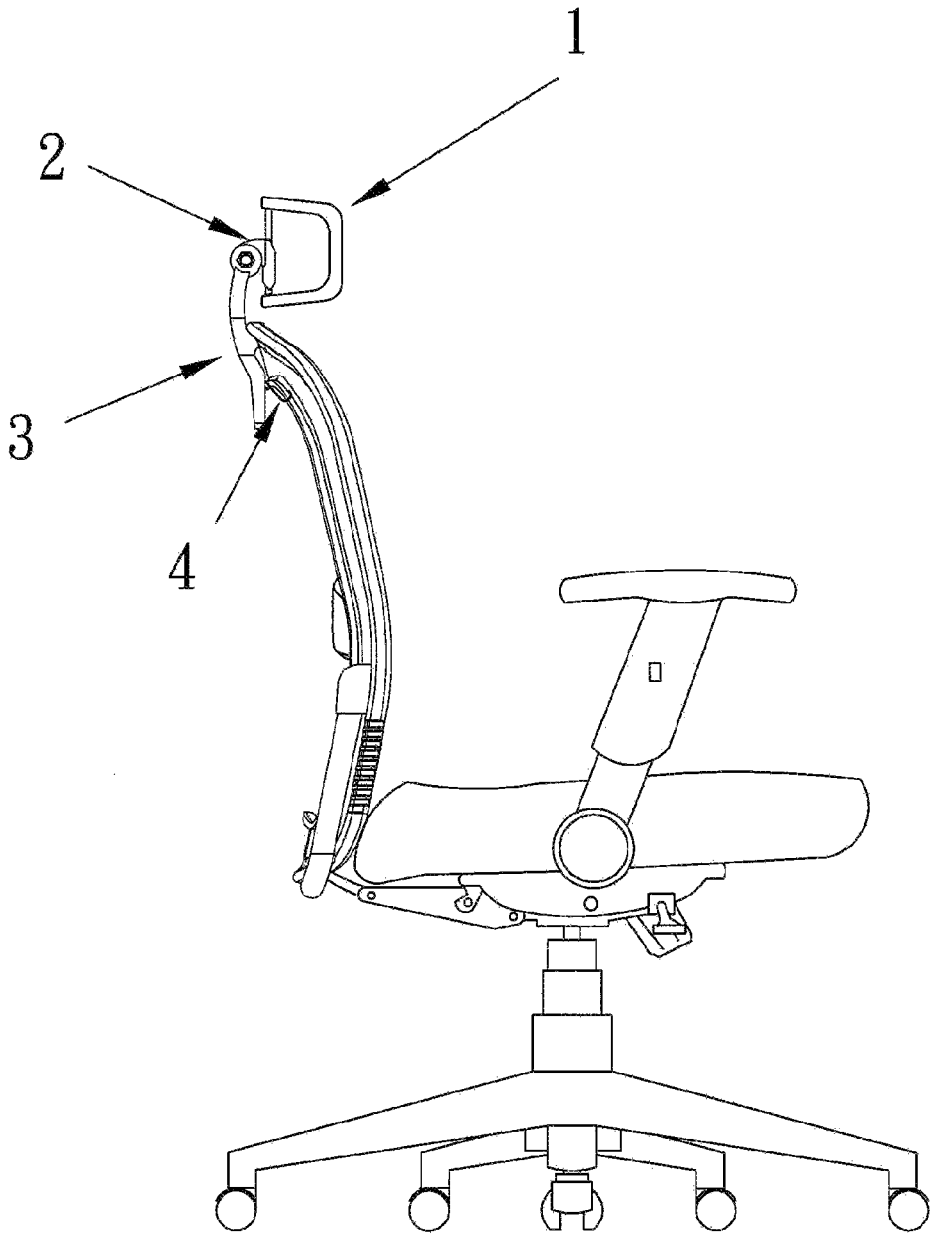
FIG. 3 is a side view of the headrest of the office chair in the present invention, showing the headrest being adjusted in its height.

In assembling, as shown in FIGS. 2 and 3, the support frame 3 with the hook 4 together can easily be combined tightly on a backrest of an office chair, by means of the two hooks 33 of the support frame 3 and the hook 4 hooking stably with the backrest and fastening tightly with the fasteners 5 fixing the hook 4 so the headrest in the invention may be assembled or disassembled from an office chair. Moreover, the backrest of an office chair needs no special components for combining the headrest.

Next, in order to adjust the height of the headrest, referring to FIG. 3, the body 1 is moved up and down by the shafts 11 moving up and down in the through holes 21 of the connecting blocks 2.

Figure 4:
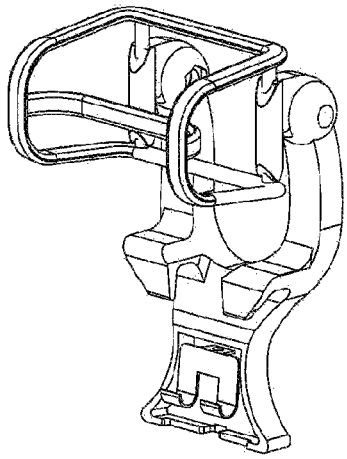
FIG. 4 is a side view of the headrest of the office chair being adjusted in its angle in the present invention; and, FIG. 5 is a side view of the headrest of the office chair in the present invention.
Figure 4:
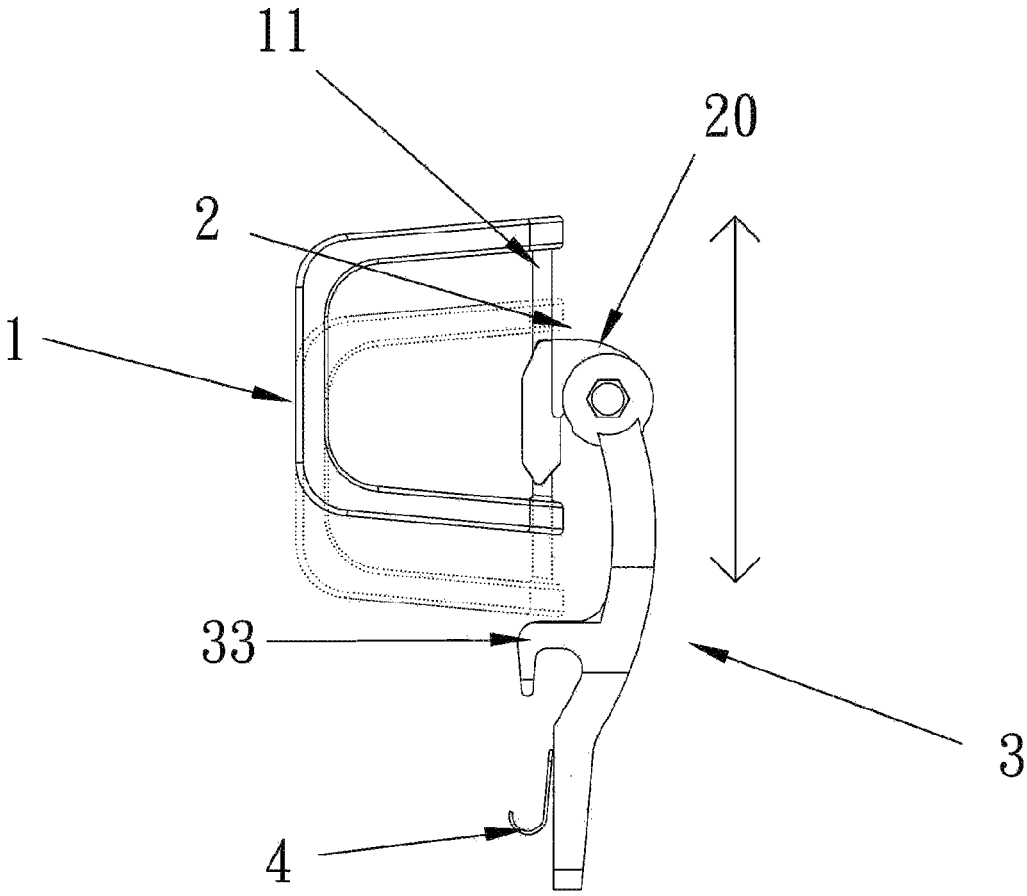
Figure 5:
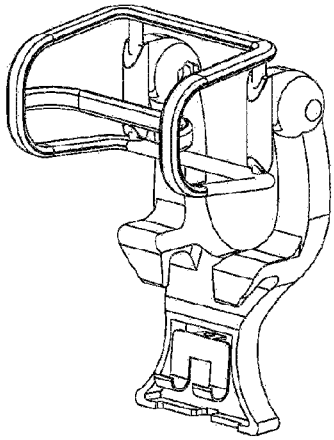
Figure 5:
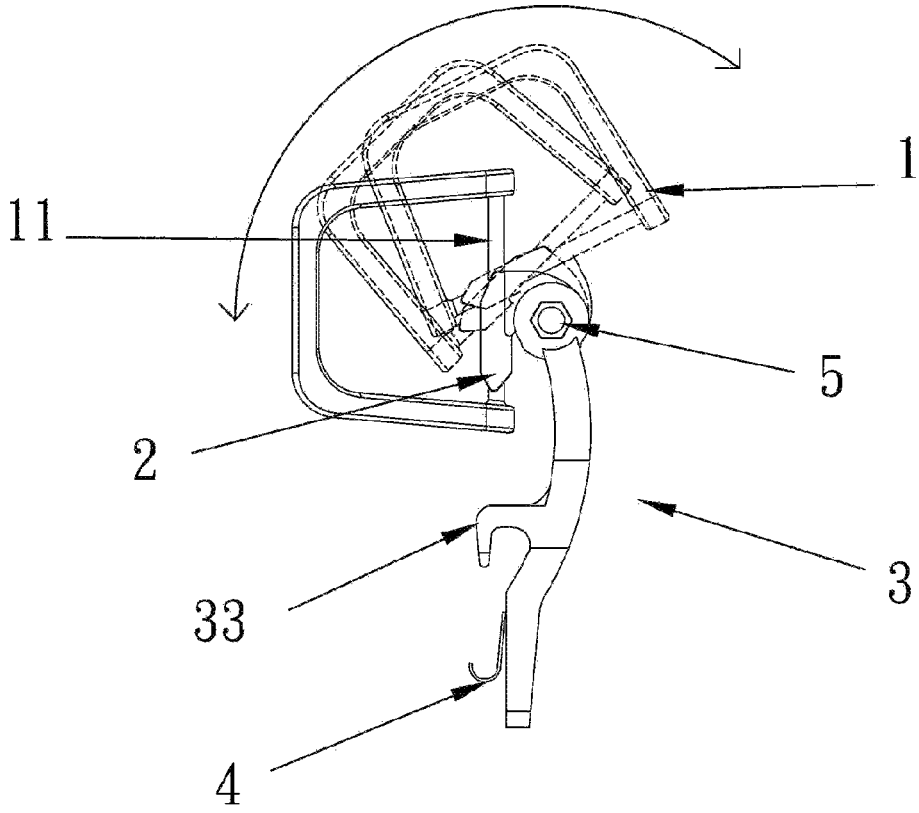

In order to adjust the angle of the headrest, referring to FIG. 4, push the body to swing up or down with the fastener 5 located in the through hole 30 of the support rods 3 loosened a little and functioning as a pivot, and then screwing tight the fastener 5 after the angle is adjusted as wanted.

Thus, a user can adjust the angle and the height of the headrest to suit to the user's height to get a comfortable sitting position.

While the preferred embodiment of the invention has been described above, it will be recognized and understood that various modifications may be made therein and the appended claims are intended to cover all such modifications that may fall within the spirit and scope of the invention.

What is claimed is:

1. A headrest for an office chair comprising:

a headrest body for a head of a user to rest on, provided with a layer of soft material wrapped around said headrest body and two shafts in an inner portion;

two connecting blocks respectively provided with a hollow column combined with said shafts of said headrest body, two projecting blocks extending from said hollow columns respectively, said projecting block having a through hole for a fastener to fit in for fixing with a support frame;

said support frame has a shape of Y, provided with a ball-shaped end respectively formed at an outer end of two side rod portions, said ball-shaped end provided with a center slot for said two projecting blocks to fit stably therein, a hook respectively extending from an intermediate portion of said two side rod portions, a recess formed in a lower portion of said support frame;

a hook with a shape of L and having two curved ends; and said ball-shaped end of said support frame is provided with a threaded hole.

2. The headrest for an office chair as claimed in claim 1, wherein said hook is provided with a threaded hole in a rear portion for a fastener to fix tightly said hook in said recess of said support frame.

3. The headrest for an office chair as claimed in claim 1, wherein said threaded hole of said ball-shaped end is provided with a nut recess.

4. The headrest for an office chair as claimed in claim 1, wherein said recess of said support frame is provided with a threaded hole in an upper wall.

* * * * *